US012256839B1

(12) United States Patent
Novak et al.

(10) Patent No.: US 12,256,839 B1
(45) Date of Patent: Mar. 25, 2025

(54) LOCKING GUN DISPLAY ASSEMBLY

(71) Applicant: Quality Wood Designs Inc., Mitchell, SD (US)

(72) Inventors: Nicholas Novak, Mitchell, SD (US); Michael Honermann, Mitchell, SD (US)

(73) Assignee: Quality Wood Designs Inc., Mitchell, SD (US)

( * ) Notice: Subject to any disclaimer, the term of this patent is extended or adjusted under 35 U.S.C. 154(b) by 25 days.

(21) Appl. No.: 18/148,012

(22) Filed: Dec. 29, 2022

Related U.S. Application Data

(60) Provisional application No. 63/336,029, filed on Apr. 28, 2022, provisional application No. 63/299,235, filed on Jan. 13, 2022.

(51) Int. Cl.

| | |
|---|---|
| ***A47B 81/00*** | (2006.01) |
| ***F41A 17/02*** | (2006.01) |
| ***F41A 23/18*** | (2006.01) |

(52) U.S. Cl.
CPC ..... *A47B 81/005* (2013.01); *F41A 17/02* (2013.01); *F41A 23/18* (2013.01)

(58) Field of Classification Search
CPC ..... A47B 81/005; F41A 17/02; F41A 23/18
See application file for complete search history.

(56) References Cited

U.S. PATENT DOCUMENTS

| | | | | |
|---|---|---|---|---|
| 2,664,658 | A * | 1/1954 | Bjorklund | F41A 17/54 42/70.07 |
| 2,958,422 | A | 11/1960 | Caloiero | |
| 3,392,471 | A * | 7/1968 | Foote | F41A 17/02 42/70.07 |
| 3,422,560 | A * | 1/1969 | Foote | F41A 17/54 42/70.07 |
| 3,616,559 | A * | 11/1971 | Sobolewski | F41A 17/02 42/70.07 |
| 3,624,945 | A * | 12/1971 | Foote | F41A 17/02 42/70.07 |

(Continued)

FOREIGN PATENT DOCUMENTS

| | | |
|---|---|---|
| FR | 2337325 A1 * | 7/1977 |
| GB | 2445210 | 3/2011 |

(Continued)

*Primary Examiner* — Stanton L Krycinski
(74) *Attorney, Agent, or Firm* — Mai D. Lauer; Westman, Champlin & Koehler P.A.

(57) ABSTRACT

An assembly is configured for use with a firearm having a trigger guard. The assembly includes a firearm holder comprising a body and a trigger peg. The body includes an internal channel, a plunger lock, and a lock plate comprising a first interlock surface. The trigger peg includes a stem and a trigger flange. The stem is configured for insertion through the trigger guard and into the internal channel, the stem including a second interlock surface configured to mate with the first interlock surface. The trigger flange is sized to not pass through the trigger guard. A method of securing a firearm having a trigger guard is described. The method includes positioning the trigger guard at a body of a firearm holder, inserting a stem of a trigger peg through the trigger guard and into the body of the firearm holder, and locking the trigger peg to the body.

20 Claims, 10 Drawing Sheets

(56) References Cited

U.S. PATENT DOCUMENTS 3,637,180 A * 1/1972 Parry ..... E05B 73/00 42/70.07
3,664,163 A 5/1972 Foote
3,927,923 A 12/1975 Kimmel
4,139,100 A * 2/1979 Reed ..... A47B 81/005 211/64
4,182,453 A * 1/1980 Worswick ..... F41A 23/00 211/64
4,198,026 A * 4/1980 Capolupo ..... F41A 17/02 42/70.07
4,204,601 A 5/1980 Thomas
4,328,687 A * 5/1982 Ritchie ..... E05B 73/00 42/70.07
4,335,872 A 6/1982 Caplis et al.
4,461,385 A 6/1984 Clouser
4,624,372 A * 11/1986 Brolin ..... F41A 17/02 42/70.11
4,696,405 A * 9/1987 Waring ..... F41A 23/18 211/64
5,020,259 A * 6/1991 Mossberg ..... F41A 17/02 42/70.11
5,022,534 A * 6/1991 Briggs ..... A47F 7/024 42/70.11
5,022,536 A 6/1991 Pierson
5,048,212 A 9/1991 Mossberg
5,287,972 A * 2/1994 Saathoff ..... A47B 81/005 42/70.11
5,325,686 A 7/1994 Bentley
5,437,119 A * 8/1995 Womack ..... F41A 17/54 42/70.07
5,524,772 A 6/1996 Simmons
5,535,537 A * 7/1996 Avganim ..... F41A 17/54 42/70.07
5,548,915 A * 8/1996 Szarmach ..... F41A 17/02 70/38 R
5,579,923 A * 12/1996 Hemmerlein ..... F41A 23/18 42/70.11
5,638,627 A * 6/1997 Klein ..... F41A 17/54 42/70.07
5,755,054 A * 5/1998 Tuller ..... F41A 17/54 42/70.07
5,934,112 A 8/1999 Rice et al.
6,052,934 A 4/2000 Carpenter
6,142,313 A * 11/2000 Young ..... F41A 23/18 42/70.11
6,256,920 B1 7/2001 Olson
6,308,540 B1 * 10/2001 Lee ..... E05B 73/0005 42/70.07
6,330,815 B1 * 12/2001 Duncan ..... E05B 67/36 211/64
6,336,283 B1 * 1/2002 Ortiz ..... F41A 19/09 89/27.3
6,393,750 B1 * 5/2002 Rossini ..... F41A 17/44 42/70.11
6,405,469 B1 * 6/2002 Walsh ..... F41A 17/02 42/70.07
6,804,906 B1 10/2004 Olsen
6,863,185 B2 3/2005 Mele et al.
7,281,397 B2 * 10/2007 Victor ..... F41A 17/066 42/70.07
7,478,892 B2 1/2009 Punzel et al.
7,584,566 B2 * 9/2009 Victor ..... F41A 17/54 42/70.07
7,770,740 B2 * 8/2010 Punzel ..... F41A 23/18 211/64
8,347,664 B2 * 1/2013 Bishir, Jr. ..... E05B 67/24 70/61
9,198,512 B1 12/2015 Moayeri
10,072,904 B2 9/2018 Binns
10,180,297 B2 * 1/2019 Post ..... F41A 17/04
10,401,106 B1 * 9/2019 McMurray ..... F41A 17/02
12,007,186 B2 * 6/2024 Eckelkamp ..... F41A 17/54
2003/0213273 A1 * 11/2003 Vercoe ..... A47B 81/005 70/62
2004/0129038 A1 * 7/2004 Vercoe ..... A47B 81/005 70/58
2004/0164036 A1 8/2004 Cummins
2005/0145585 A1 * 7/2005 Pintar ..... A47B 81/005 211/96
2006/0283820 A1 12/2006 Peters et al.
2007/0024165 A1 2/2007 Moulton
2012/0152767 A1 6/2012 Harry
2015/0033609 A1 * 2/2015 Herdman ..... F41A 17/54 42/70.07
2017/0122010 A1 * 5/2017 McCanna ..... A47B 81/00

FOREIGN PATENT DOCUMENTS

WO 2020117697 6/2020
WO 2021005262 1/2021

* cited by examiner

LOCKING GUN DISPLAY ASSEMBLY

CROSS REFERENCE TO RELATED APPLICATIONS

This application claims the benefit of priority of Provisional U.S. Patent Application 63/299,235 filed Jan. 13, 2022 for "Cable Assembly for Securing Firearms." This application also claims the benefit of priority of Provisional U.S. Patent Application 63/336,029 filed Apr. 28, 2022 for "Handgun Display Assembly with Locking Apparatus." The contents of these priority applications are hereby incorporated by reference in their entireties.

BACKGROUND

For promoting sales of firearms, retailers often wish to display their inventory for easy perusal by customers. However, the displayed firearms should also be secured against unauthorized handling. A conventional secure storage unit for firearms, such as a gun safe, often has a disadvantage of hiding the secured firearms from view, thereby requiring the time and attention of a sales person in order to even allow a customer to visually inspect the merchandise. Other displays that do not visually obscure the merchandise may not provide a high level of security. For example, locks may be used to secure the cabinet doors of display cabinets. However, breaking a single lock on a display cabinet door could allow a thief to access all of the firearms housed in the cabinet.

SUMMARY

In one aspect, an assembly is configured for use with a firearm having a trigger guard. The assembly comprises a firearm holder comprising a body and a trigger peg. The body comprise an internal channel, a plunger lock, and a lock plate comprising a first interlock surface. The trigger peg comprises a stem and a trigger flange. The stem is configured for insertion through the trigger guard and into the internal channel, the stem comprising a second interlock surface configured to mate with the first interlock surface. The trigger flange is sized to not pass through the trigger guard.

In another aspect, a method of securing a firearm having a trigger guard is described. The method comprises positioning the trigger guard at a body of a firearm holder, inserting a stem of a trigger peg through the trigger guard and into the body of the firearm holder, and locking the trigger peg to the body of the firearm holder.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. All descriptions are applicable to like and analogous structures throughout the several embodiments, unless otherwise specified.

Figure 1:
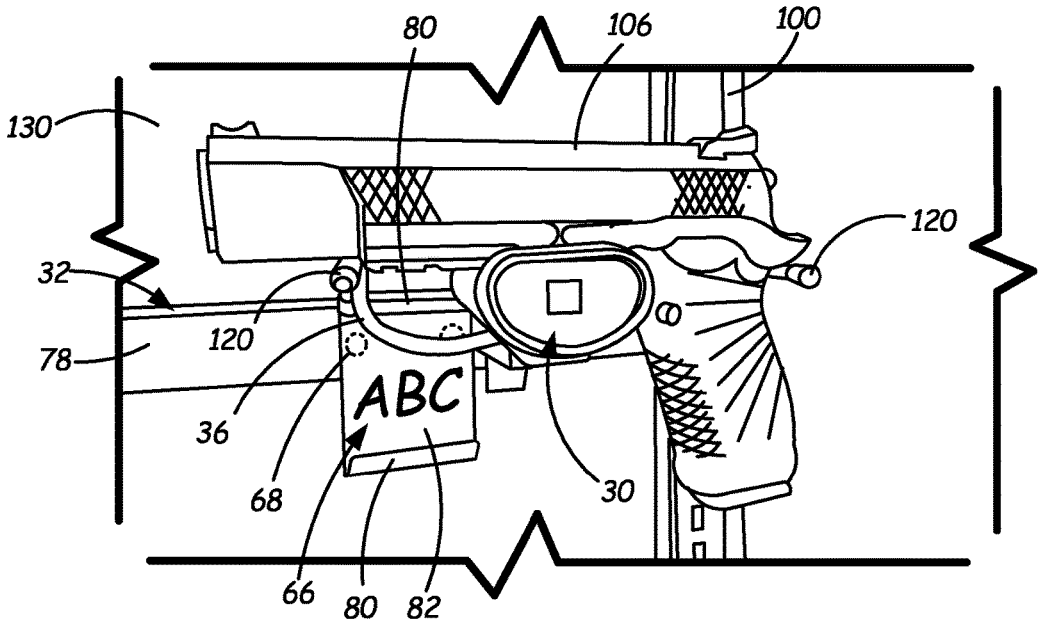
FIG. 1 is a front perspective view of an assembly of an exemplary locking firearm holder with a firearm held thereby.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

The same or similar reference numerals are used in different figures for the same or similar elements. All descriptions of an element also apply to all other versions of that element unless otherwise stated. The terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps and do not supply a serial or numerical limitation on the elements or steps of the embodiments thereof. For example, "first," "second," and "third" elements or steps need not necessarily appear in that order, and the embodiments thereof need not necessarily be limited to three elements or steps. Unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. The singular forms of "a," "an," and "the" include plural references unless the context clearly dictates otherwise.

DETAILED DESCRIPTION

Figure 2:
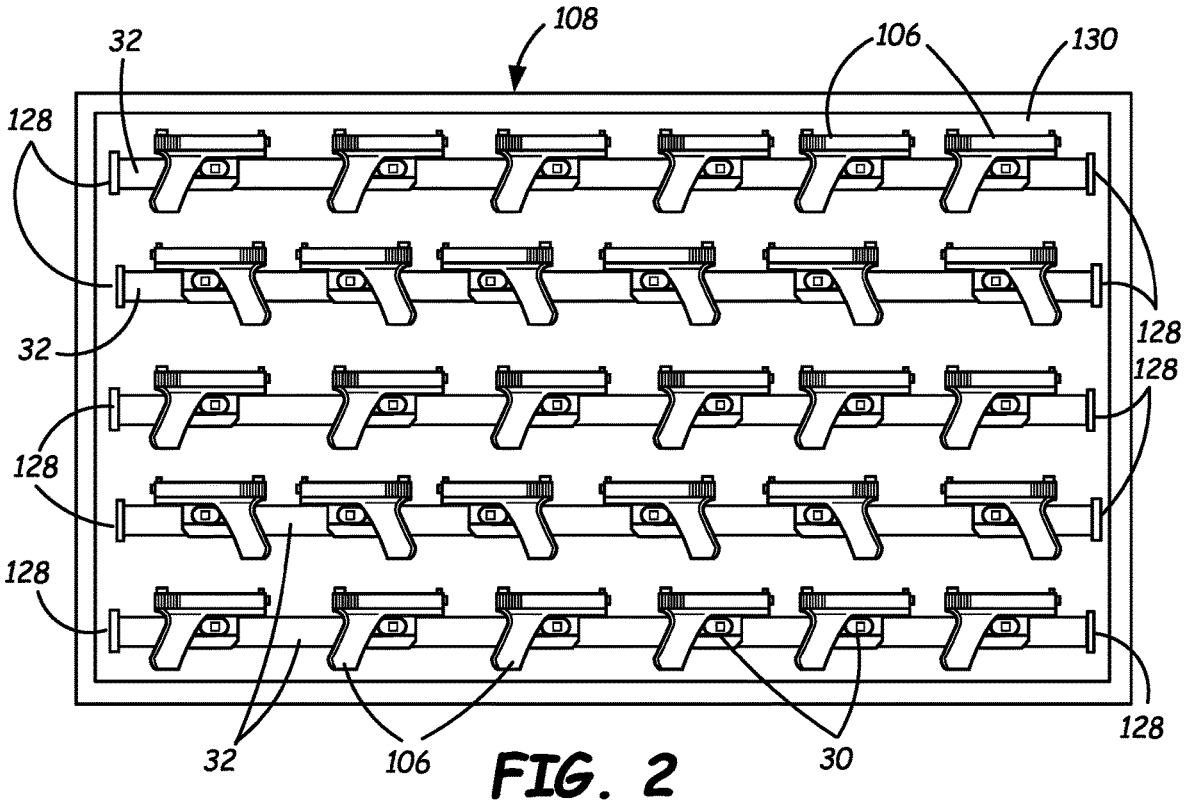
FIG. 2 is a front elevation view of a plurality of such assemblies arranged in a cabinet.

FIG. 1 is a front view of an exemplary firearm holder 30 with a firearm 106 locked therein. FIG. 2 is a front view of a plurality of such firearm holders 30 with locked firearms 106 arranged in a display cabinet 108. As shown in FIG. 1, the firearm 106 is locked into the firearm holder 30 by a part of the holder 30 that is inserted through the firearm's trigger guard. Additionally, the firearm 106 is held in some cases by a support wire 36 attached to the firearm holder 30. In an exemplary embodiment, the firearm holder 30 is mounted on rail 32 that is in turn attached to vertical support 100 on wall 130.

Figure 13:
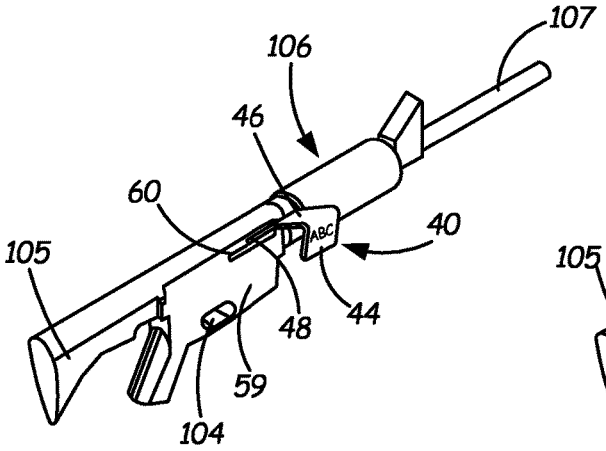
FIG. 13 is a perspective view of a firearm with the securing bracket being inserted into its shell ejection slot.
Figure 14:
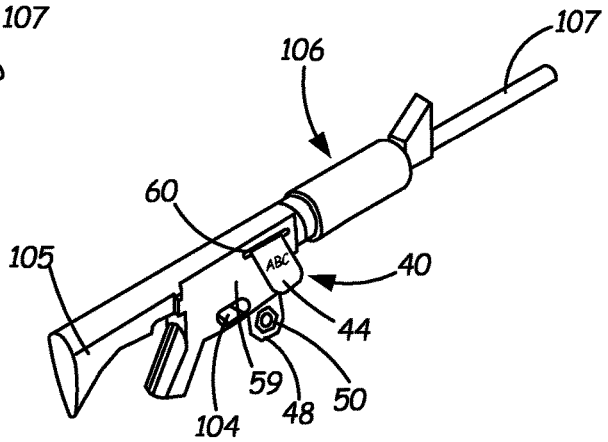
FIG. 14 is similar to FIG. 13 but shows full insertion of the securing bracket into the firearm, through its shell ejection slot and into and through its magazine well.
Figure 15:
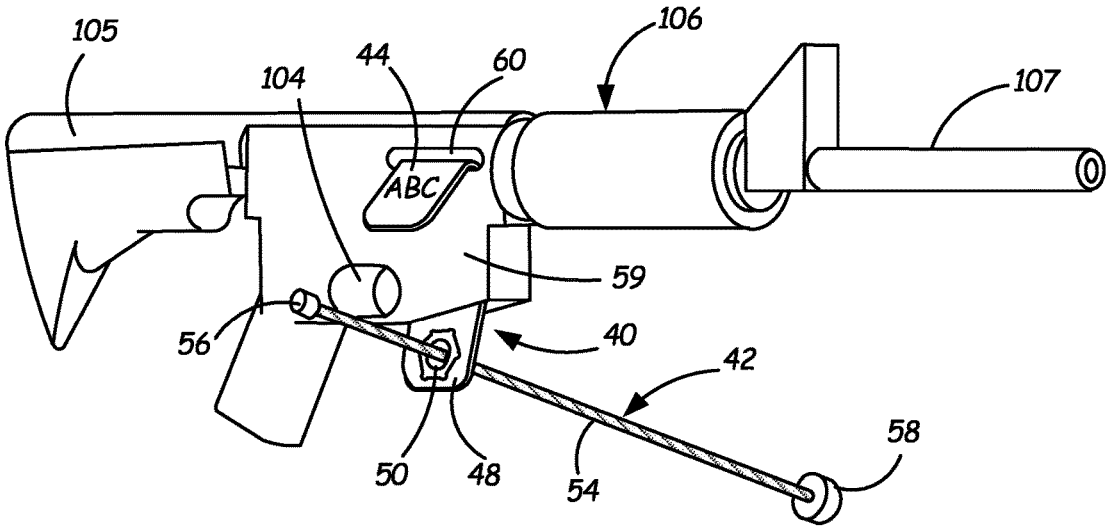
FIG. 15 is a perspective view of the firearm with one end of the cable inserted into an aperture of the securing bracket.

Suitable firearms 106 for use with the described firearm holder 30 include automatic rifles, semi-automatic rifles, shotguns, pistols, airsoft guns, pellet guns, BB guns (e.g., steel ball guns), or paintball guns, for example. As illustrated in FIGS. 13-15, some firearms 106 have stocks 105 and muzzles or barrels 107.

As show in FIGS. 2-4, 7 and 16, in exemplary embodiments, rail 32 is secured to a structure, such as a vertical support 100 or wall 130 of cabinet 108 by mounting brackets 128 at each end of rail 32. The mounting brackets 128 may include a hook, a z-clip, teeth, or other feature configured to engage a support structure, such as a support 100, wall 130, cabinet 108, a safe housing, or another structure. In some implementations, the rail 32 and/or mounting bracket 128 may be fastened to the support structure using screws, nails, or other fasteners.

Figure 3:
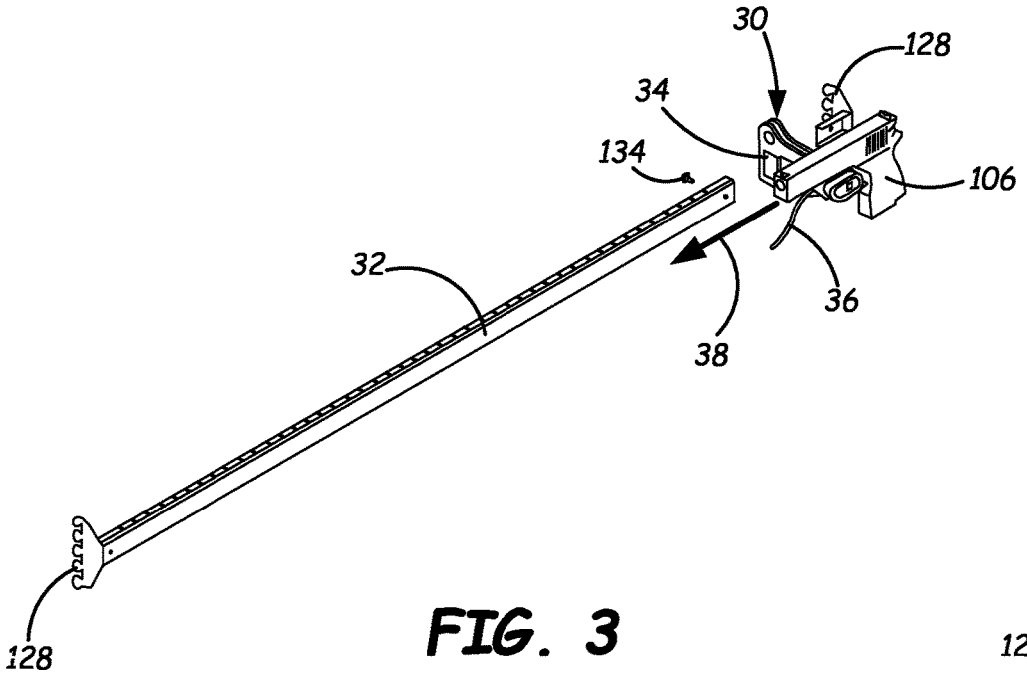
FIG. 3 is a perspective view showing a firearm holder (with a firearm) configured and positioned for slidable mounting on a rail.
Figure 4:
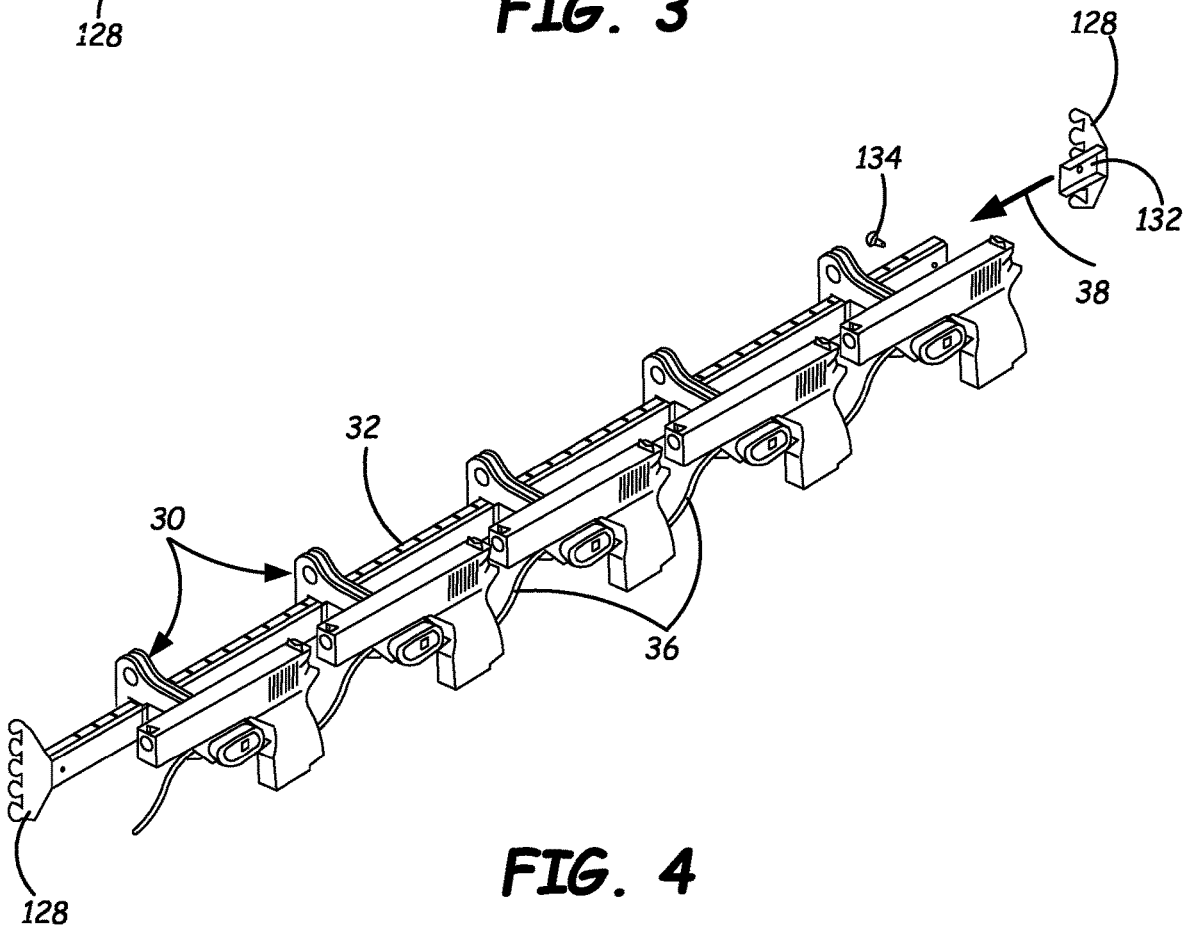
FIG. 4 is a perspective view of multiple such firearm holders mounted on the rail.

FIG. 3 is a front perspective view of a rail 32 configured for receipt of a firearm holder 30 positioned for sliding thereon in insertion direction 38. FIG. 4 shows that a plurality of such fire arm holders 30 can be slid onto rail 32 in direction 38. Mounting bracket 128 is secured to each end of rail 32 by insertion of its track 132 into an open channel of the rail 32. The mounting brackets 128 are secured to the ends of rails 32 by fasteners 134, which are configured to pass through aligned apertures of rail 32 and track 132 of mounting bracket 128.

In some exemplary embodiments, holder 30 includes an opening 34 sized to receive rail 32. In an exemplary embodiment, opening 34 has a height of 1 and 9/16 inches and a width of 13/16 inches. In an exemplary embodiment, rail 32 extends through opening 34 of holder 30, which can slide onto and off of rail 32 for adjustable spacing between adjacent holders 30. In the illustrated examples, the rail opening 34 has a substantially rectangular shape, which matches the profile of the rail 32 and which prevents rotation of the mounted firearm holder components relative to the rail 32. In an exemplary embodiment, rail 32 is a bar, rod, beam, or other rigid elongated element made of steel, carbon fiber, another metal or material or any combination thereof.

FIGS. 3 and 4 show that the holder 30 can be adjustably placed on rail 32 by sliding along the rail 32 to achieve a desired distance between adjacent holders 30, to accommodate different lengths of firearms 106. Thus, any number of holders 30 can be placed on a rail 32, and any number of rails 32 can be placed in a cabinet 108 or on a display wall 130. Thus, a vertical display space can securely and visibly display any number of firearms 106.

If a user wishes to maintain the relative spacing and positions of holders 30 on rail 32, some embodiments have a rail positioning flange 66 (labeled in FIG. 1) proximate rail opening 34. As shown in FIG. 1, rail positioning flange 66 has apertures 68, each configured to accept a set screw or other fastener for engagement with a front surface 78 of rail 32. Thus, after a user has slid each holder 30 to a desired position on rail 32, the user can insert a fastener such as a set screw into the aperture 68 to fix the respective holder 30 to the rail 32 in the desired position. In exemplary embodiments, flange 66 is configured with upper and lower lips 80 so that the flange 66 can hold a display label 82 such as a price tag or other informational card, for example.

As shown in FIGS. 5-10B, an exemplary firearm holder 30 is configured for secure display of a firearm 106, though the firearm is not depicted in these drawings so that structures of the holder 30 are more clearly visible. In an exemplary embodiment, firearm holder 30 includes body 112 and trigger peg 110. Body 112 includes aperture 34 configured for mounting and sliding on rail 32. In an exemplary embodiment, body 112 includes an engagement flange 114 that is larger than a trigger assembly or trigger guard 104 on firearm 106 (labeled in FIGS. 13-15). The engagement flange 114 may be coated with rubber, silicon, or another material to prevent scratching of the surface of the firearm 106. The engagement flange 114 may contact the trigger assembly of the firearm 106 on a back side thereof.

Figure 5:
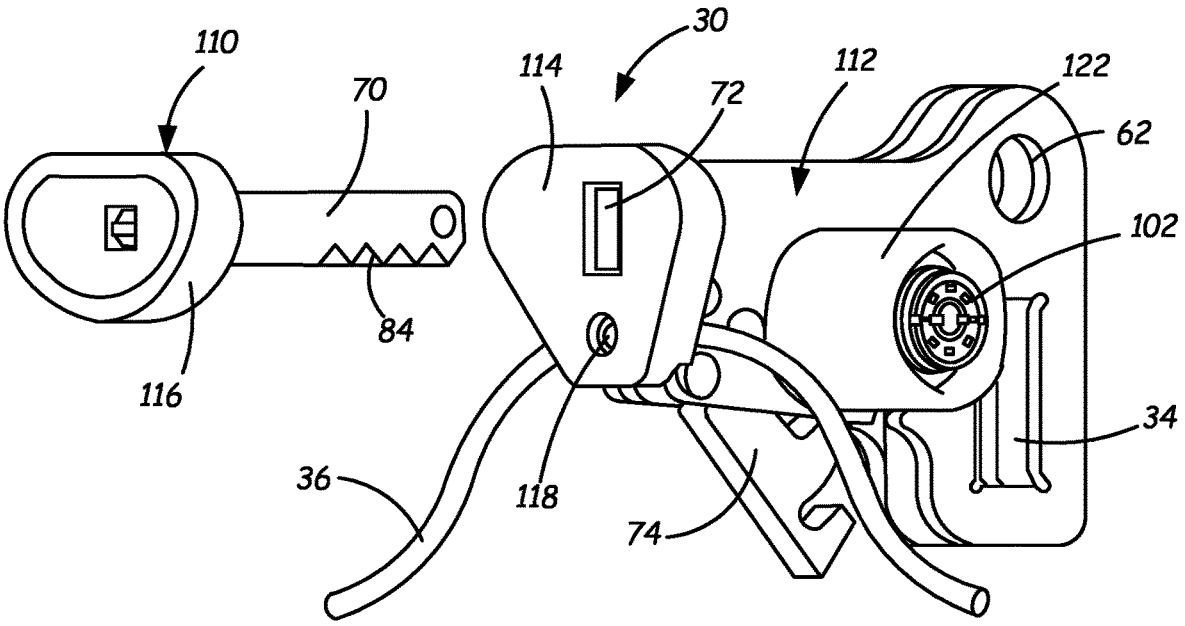
FIG. 5 is a right perspective view of the exemplary firearm holder in an unlocked configuration, and with a firearm support wire.
Figure 6:
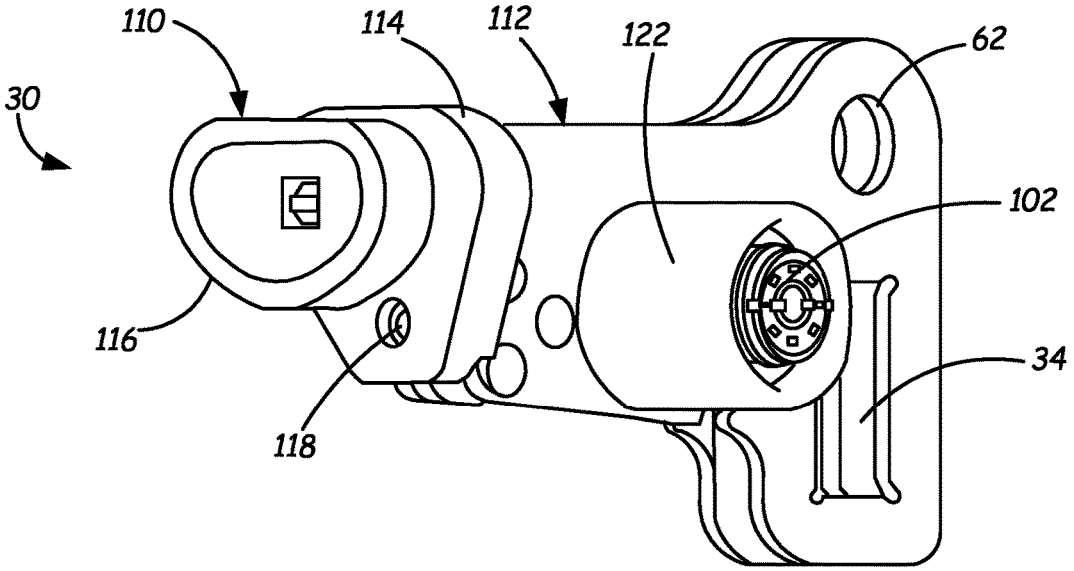
FIG. 6 is a right perspective view of the exemplary firearm holder in a locked configuration, without a firearm support wire.

In an exemplary embodiment, trigger peg 110 also includes a trigger guard flange 116, which may be coated with a rubber, silicon, or another material to prevent scratching of the surface of the firearm 106. The trigger guard flange 116 may contact the trigger assembly of the firearm 106 on a front side of the firearm 106, as shown in FIGS. 1-4 and 16-19. In an exemplary embodiment as shown in FIG. 5, trigger peg 110 includes a toothed stem 70 that is configured for insertion through the trigger guard of the firearm 106 and into opening 72 in body 112. Toothed stem 70 is configured for locking engagement with a complementarily toothed lock plate 74 (labeled in FIGS. 5 and 9A-10B)

in body 112. The stem 70 and lock plate 74 are held in an engaged, locked configuration by lock 102, which in an exemplary embodiment is a plunger lock with plunger pin 142 configured to extend through pin aperture 98 of lock plate 74, as shown in FIGS. 9A-10B. As shown in FIG. 1 for example, when the trigger peg 110 is secured to the body 112, the firearm 106 is secured between engagement flange 114 and trigger guard flange 116 and cannot be removed without unlocking the lock 102 using key 96.

Figure 7:
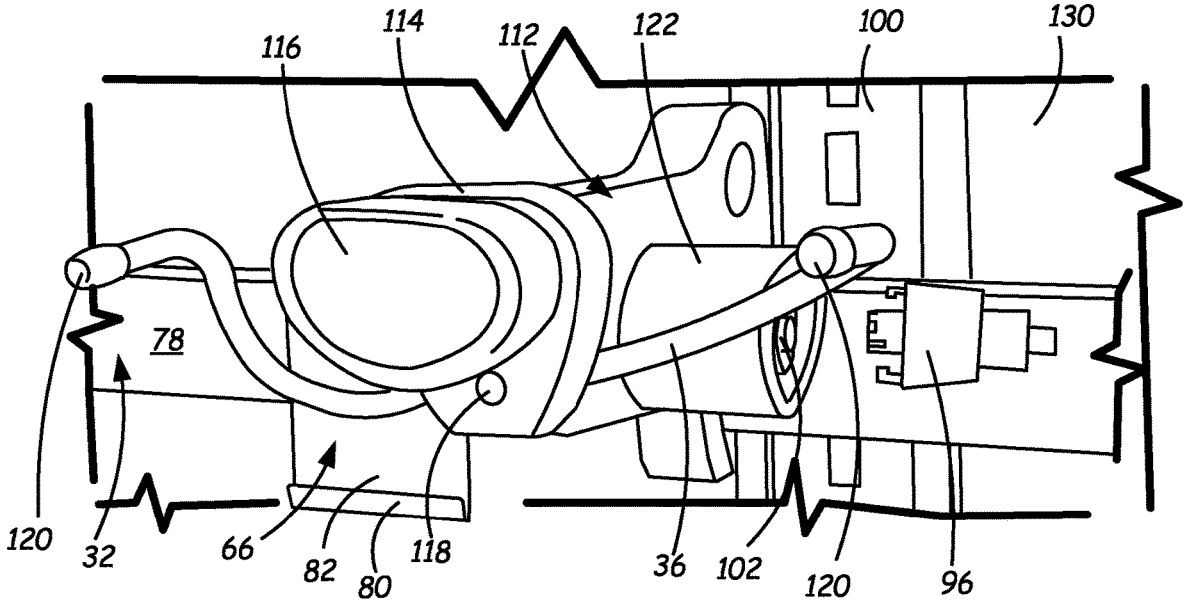
FIG. 7 is a perspective view of the exemplary firearm holder with a key to the lock positioned for insertion.
Figure 20:
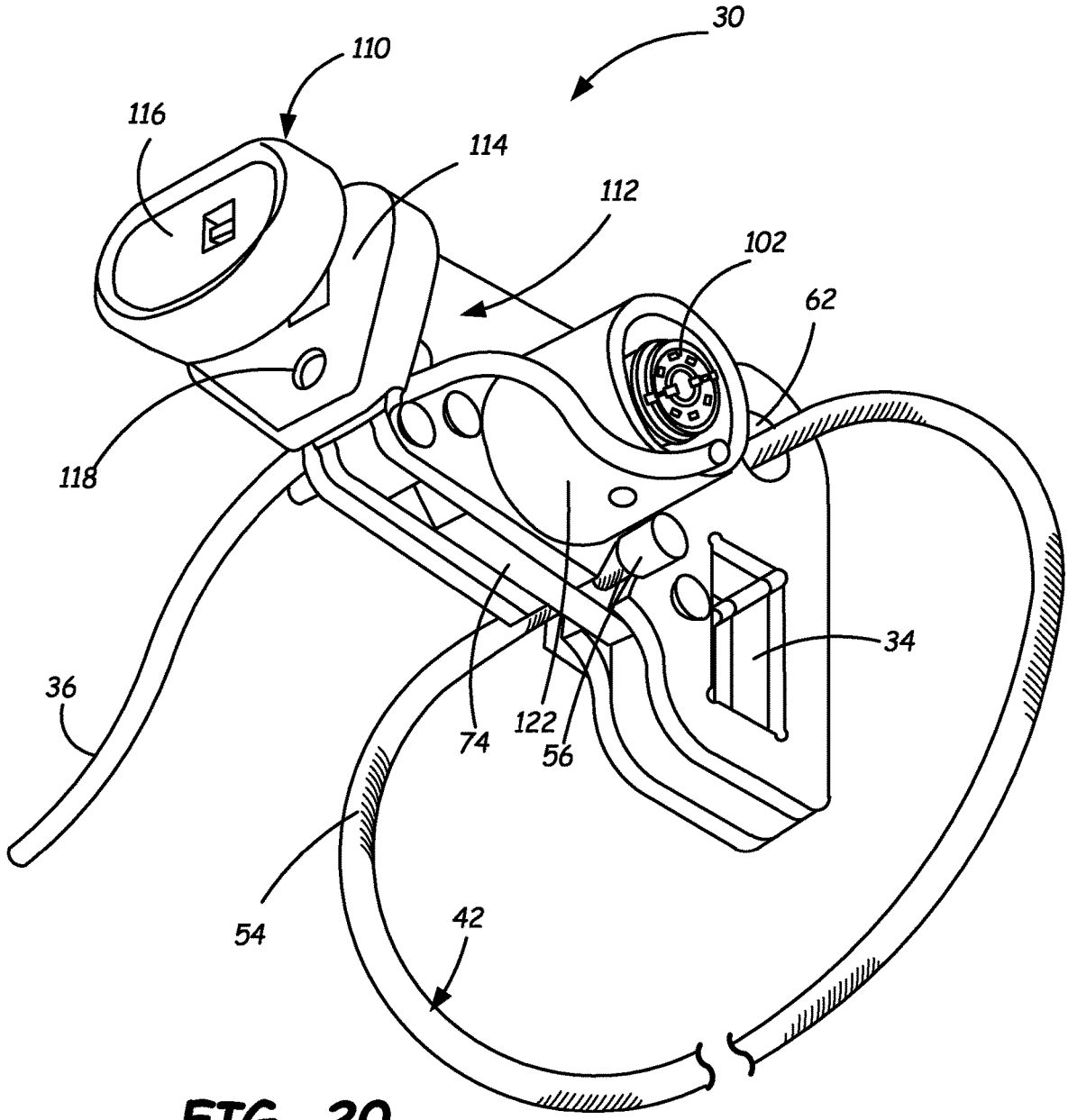
FIG. 20 is a right bottom perspective view of a locked firearm holder with an inserted cable.

As shown in FIGS. 5, 7 and 20 for example, a support wire 36 is inserted through aperture 92 (labeled in FIGS. 9B and 10B) in body 112 and can be secured in its aperture by a set screw or similar fastener (not shown) inserted through aperture 118 of engagement flange 114. In an exemplary embodiment, support wire 36 is a malleable yet strong repositionable wire that can be shaped in various curved configurations to serve as a support for the barrel and trigger handle of a firearm 106, as shown in FIG. 1. In an exemplary embodiment, support wire 36 is formed of a 0.85-foot-long segment of one-quarter inch diameter copper wire covered with a non-scratch polymer sleeve. Moreover, the support wire 36, as shown in FIGS. 1 and 7, can be capped at both ends with rubber end caps 120 to maintain the non-scratch polymer sleeve over the copper wire.

In many drawings, support wire 36 is depicted as hanging downward, so that it does not obscure other structures of the firearm holder 30. However, it is expected that in use, a user will bend the support wire 36 to custom form a support structure for a firearm 106 to the size and shape and desired support orientation, as shown in FIGS. 1 and 7, for example. Support wire 36 is an optional component and can be removed from firearm holder when its use with a particular firearm 106 is not desired.

Returning to FIGS. 5-8, in an exemplary embodiment, body 112 of firearm holder 30 includes a reinforcement cylinder 122 disposed around the lock 102. In an exemplary embodiment, reinforcement cylinder 122 is formed of steel or another rigid material to protect lock 102 from tampering, such as an attempt to break off lock 102.

Figure 8:
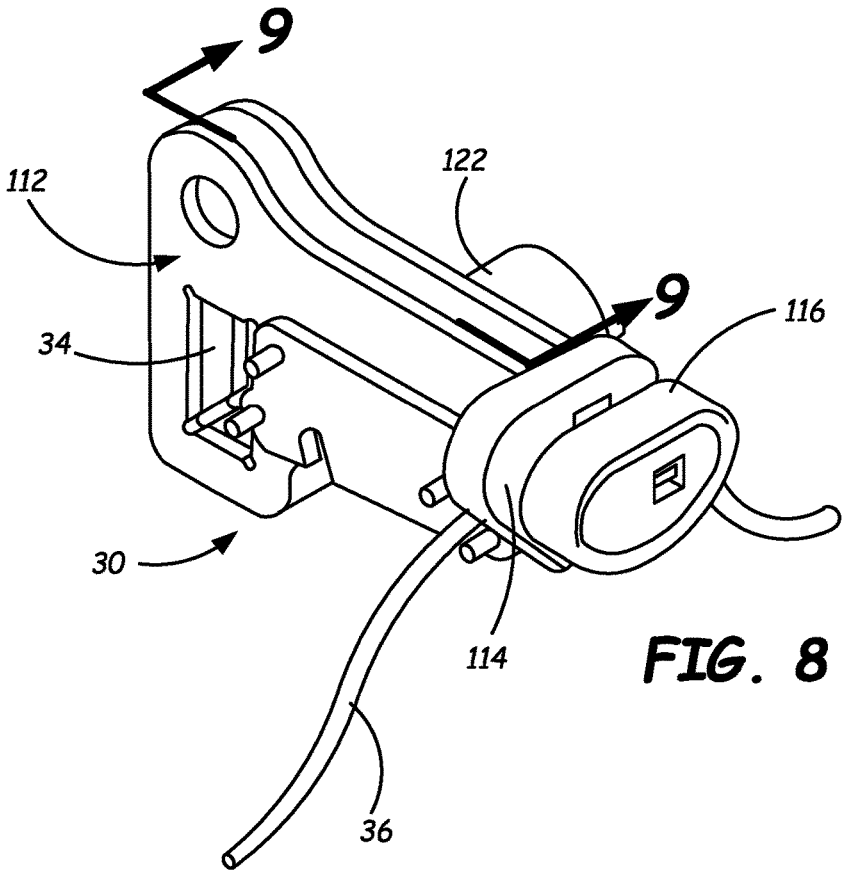
FIG. 8 is a left perspective view of the exemplary firearm holder in a locked configuration.
Figure 9A:
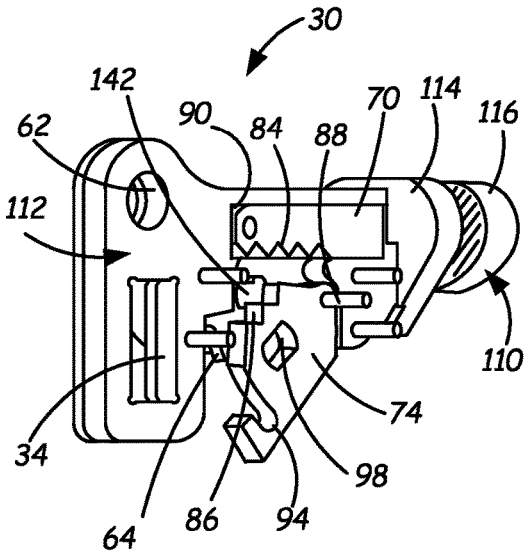
FIG. 9A is a partial interior view of the firearm holder in an unlocked configuration; a left plate of body 112 (along line 9-9 of FIG. 8) has been removed.
Figure 9B:
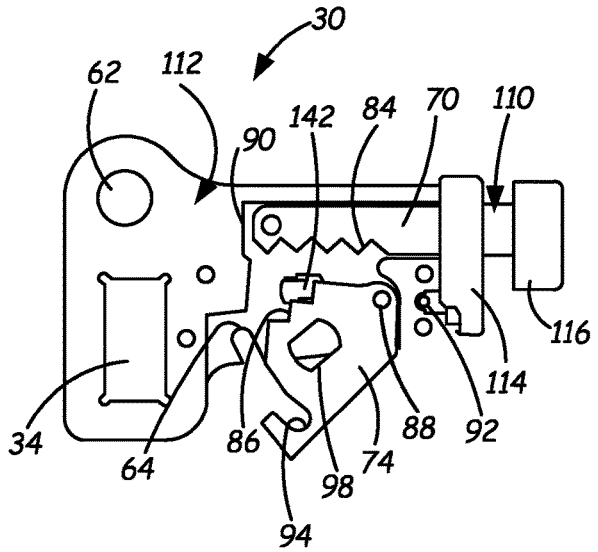
FIG. 9B is a side elevation view of the components of FIG. 9A.
Figure 10A:
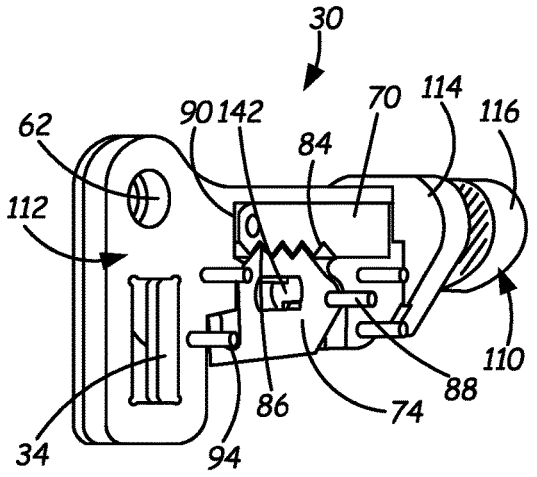
FIG. 10A is a partial interior view of the firearm holder in a locked configuration, as in FIG. 8; a left plate of body 112 (along line 9-9 of FIG. 8) has been removed.
Figure 10B:
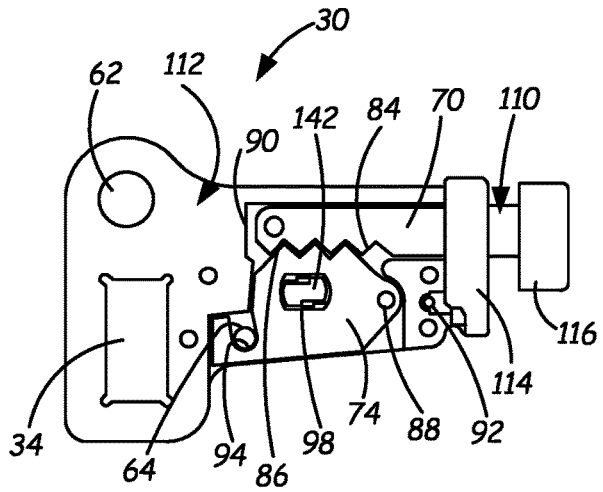
FIG. 10B is a side elevation view of the components of FIG. 10A.

FIGS. 9A-10B are partial interior views of the firearm holder 30, as viewed at line 9-9 of FIG. 8. FIGS. 9A and 9B show the firearm holder 30 in an unlocked state and FIGS. 10A and 10B show the firearm holder 30 in a locked state. Stem 70 of trigger peg 110 in an exemplary embodiment includes a serrated edge 84 that is configured to securely mate with a corresponding serrated edge 86 of lock plate 74. As illustrated, the interlocking edges 84, 86 have complimentary teeth; however, other interlocking edge structures are suitable, such as projections and recesses; undulating waves, dentils, and barbs and notches, for example. In an exemplary embodiment, interlocking edges 84, 86 can mesh in various depth positions of stem 70 in channel 90. Thus, the spacing between engagement flange 114 and trigger lock flange 116 can vary to accommodate different thicknesses of firearms 106 at their trigger guards 104. FIGS. 9B and 10B show stem 70 fully inserted into channel 90. However, if a wider gap is desired between engagement flange 114 and trigger lock flange 116, stem 70 can be inserted into channel 90 so that the teeth of edge 84 are indexed one tooth width to the right compared to the teeth of serrated edge 86.

To lock a firearm holder 30, a user pivots lock plate 74 about pivot pin 88 so that the complimentarily serrated edges 84 and 86 mate, as shown in FIGS. 10A and 10B. Channel 90 in body 112 is dimensioned to closely fit the contours of stem 70 so that when the lock plate 74 is pivoted up as in FIGS. 10A and 10B, the trigger peg 110 cannot be pulled out of the body 112. Once the lock plate 74 is in the raised position shown in FIGS. 10A and 10B, a user takes key 96 (see FIGS. 7 and 19) and inserts it into lock 102; manipulating or rotating the key 96 moves the plunger pin 142 of lock 102 to advance the pin into aperture 98 of lock plate 74 to thereby retain the lock plate in the raised position, wherein the trigger peg 110 is securely held by its stem 70 in the holder body 112. While particular structures of interlocking stem 70 and lock plate 74 are illustrated and described, it is contemplated that any interlocking structures could alternatively or additionally be used. For example, rather than complimentary serrated edges, the stem 70 and lock plate 74 could include complimentary ridges, notches, depressions, protrusions, or other mechanical locking structures.

Figure 11:
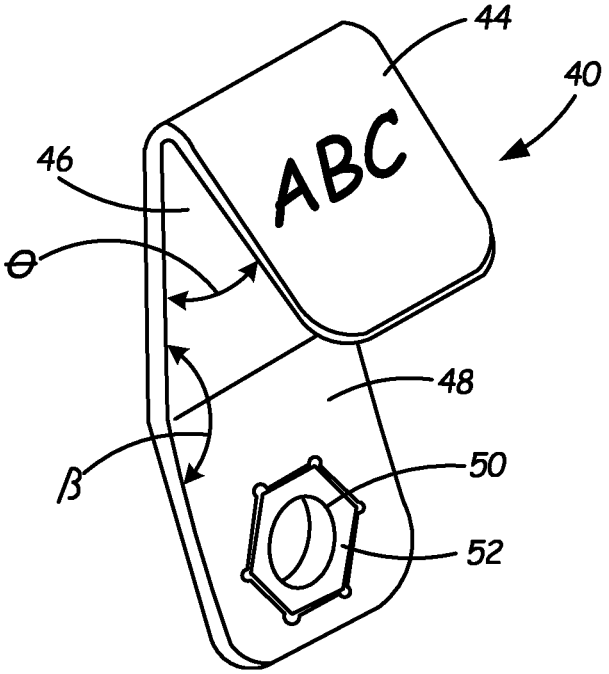
FIG. 11 is a perspective view of a securing bracket configured for insertion into the shell ejection slot and magazine well of a firearm.
Figure 12:
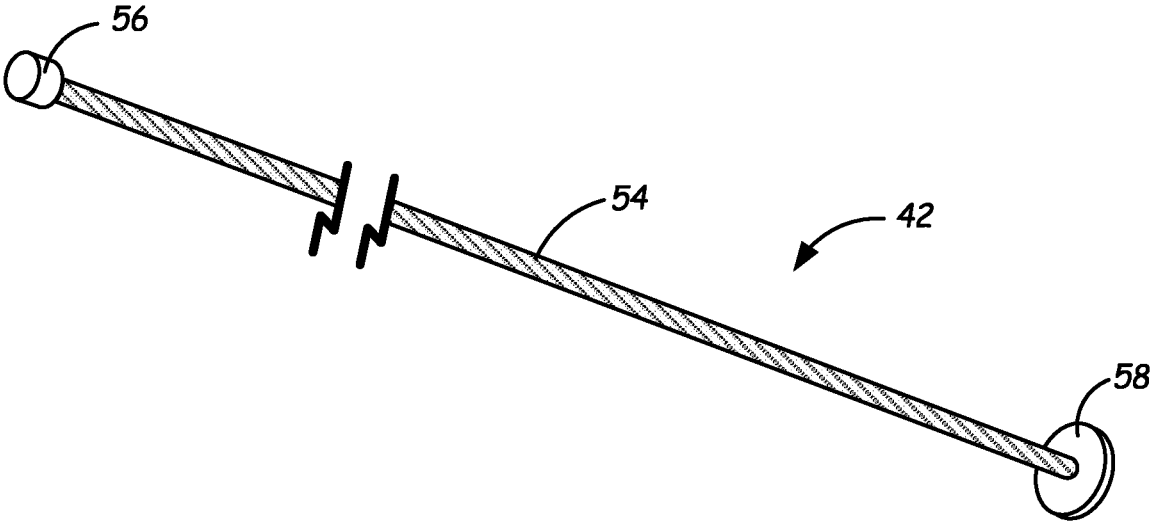
FIG. 12 is a perspective view of a cable configured for use with the bracket of FIG. 11.

FIG. 11 is a perspective view of a securing bracket 40 configured for insertion into the shell ejection slot and magazine well of a firearm that has such structures. FIG. 12 is a perspective view of a cable 42 configured for use with the bracket 40. In an exemplary embodiment, securing bracket 40 is made of a bent plate, wherein first section 44 is bent at an acute angle θ relative to middle or second section 46. In an exemplary embodiment, securing bracket 40 is made of hardened steel so that it is resistant to bending, cutting, and other deformation. Third section 48 is bent at an obtuse angle β relative to the second or middle section 46. The securing bracket 40 is configured with an overall length and width so that the middle and third sections 46, 48 may be inserted into the magazine well 59 of a firearm, while the first section 44 remains outside of a shell ejection slot 60 of the firearm 106, as shown in FIGS. 13-15 and explained further below. As such, particular dimensions of securing bracket 40 can vary, dependent upon the firearm on which it is designed to be used, though suitable dimensions include a width of up to about two inches and a length (vertically) as shown in FIG. 11 of about 5 inches. The acute angle θ is small enough that the first section 44 is prevented from following the second section 46 into the magazine well 59 of the firearm 106. The third section 48 includes an aperture 50 therethrough defined by a hardened steel nut 52 welded into the third section 48, and is long enough that the aperture 50 is readily accessible below a bottom of the magazine well 59.

FIG. 12 is a perspective view of a cable 42 configured for use with the securing bracket 40. In an exemplary embodiment, cable 42 includes a multi-strand uncoated wire cord 54 that is resistant to cutting by standard tools. Cable 42 has a small end 56 and a large end 58. A suitable uncoated cable made of hot-dipped galvanized metal and having ¼" diameter is commercially available from Rigging Warehouse Company of Saugerties, NY (on the internet at riggingwarehouse.com) under model name/number 106-GAC9/250-1000 Uncoated Galvanized Air Craft Cable ¼"×1000' 7×19 (7 strands and 19 wires per strand for high flexibility). In an exemplary embodiment, cable 42 has a breaking strength of about 7,000 pounds and a working load limit of about 1,400 pounds. An exemplary cable 42 weighs about 0.11 pound per foot of length and adheres to federal specification RR-W-410H. Cable 42 can be of any length, as suitable to provide structure to perform the described functions.

In an exemplary embodiment, small end 56 comprises a hardened steel stud that has a smaller diameter than aperture 50 of securing bracket 40. Large end 58 in an exemplary embodiment comprises a hardened steel disk with a larger diameter than aperture 50. A suitable disk for large end 58 is made of 2H hardened steel or a laser cut part of similar material and having ⅝" diameter. An exemplary part is commercially available from Fastenal Company of Winona, MN under model name/number 0169703⅝"-11 ASTM A194 Grade 2H Plain Finish Steel Jam Nut Heavy.

FIGS. 13 and 14 show insertion of securing bracket 40, with the leading end for insertion being third section 48, into the shell ejection slot 60 of a firearm 106. The illustrated firearm has stock 105 and muzzle 107. As shown in FIG. 14, because of the acute angle θ between first section 44 and middle section 46, the first section 44 remains outside of the shell ejection slot 60 while the middle section 46 is inside the firearm 106 and the third section 48 hangs below the magazine well 59 of the firearm 106. Moreover, the acute angle θ positions a front surface of the first section 44 outward and forward, toward a viewer, to offer a prominent location for display of a company name, logo or other visual indicia. The obtuse angle β allows for insertion of securing bracket 40 into a shell ejection slot 60 located on a side wall of the magazine well 59, allowing the securing bracket 40 to maneuver through the limited depth space of magazine well 59. Additionally, the obtuse angle β between the middle section 46 and the third section 48 brings the third section forward toward a user for easy access to aperture 50 which is disposed below a bottom of magazine well 59 (on a right side of the firearm 106).

FIG. 15 shows insertion of small end 56 of cable 42 through aperture 50. The cable assembly is configured so that large end 58 is too large to pass through aperture 50. With cable 42 inserted into aperture 50 of securing bracket 40, the securing bracket 40 cannot be withdrawn from the shell ejection slot 60 and magazine well of firearm 106.

Figure 16:
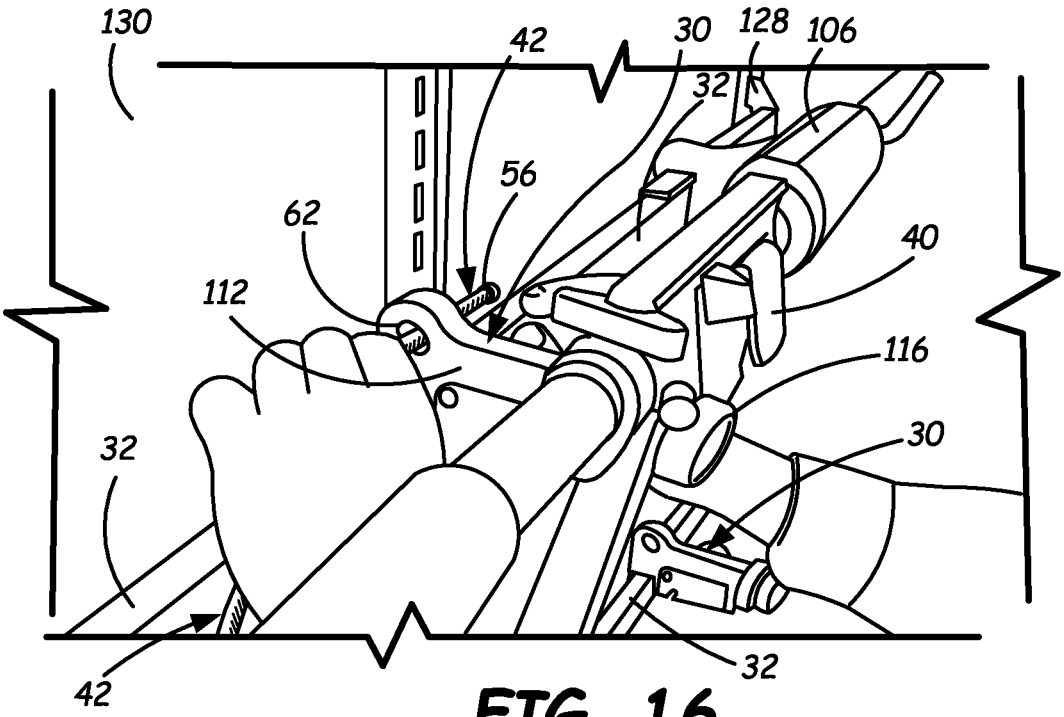
FIG. 16 is a partial perspective view showing the firearm holder with a firearm; a first end of the cable is inserted through a holder aperture.
Figure 17:
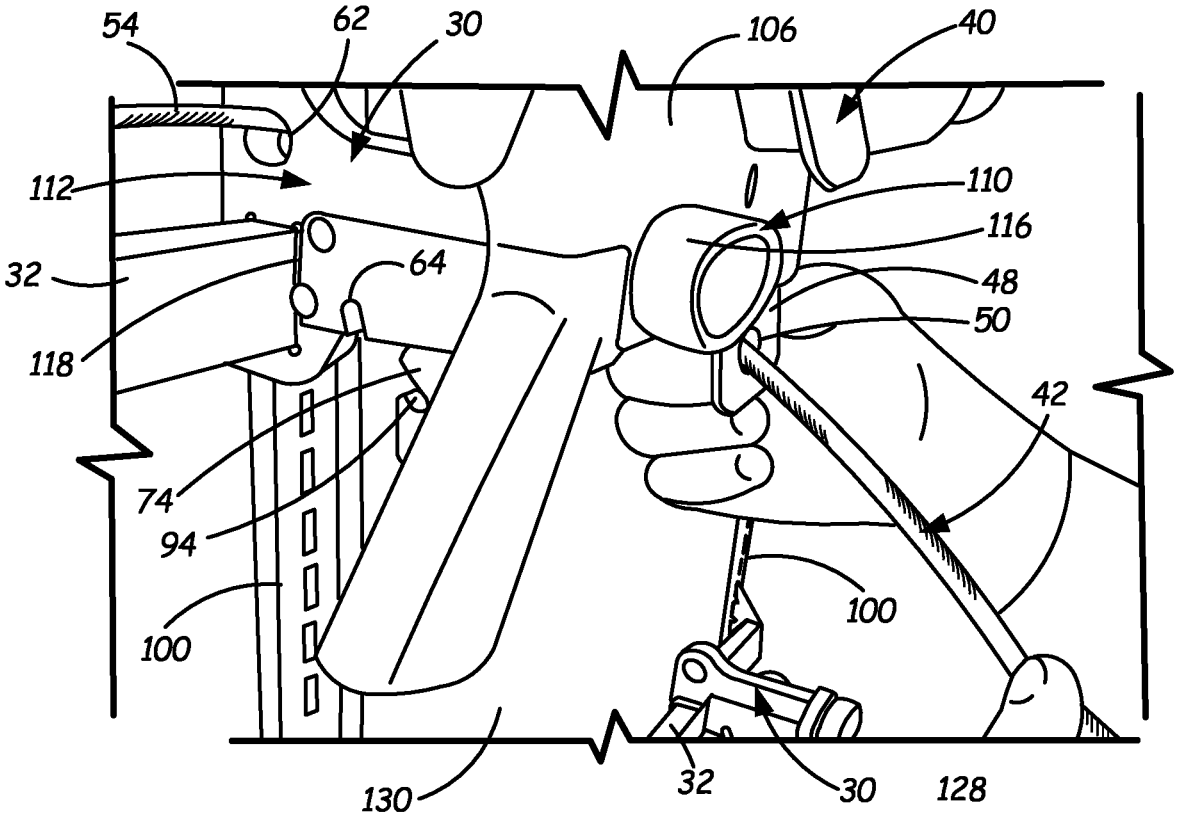
FIG. 17 is a partial perspective view showing insertion of the cable through the securing bracket that has been inserted into the shell ejection slot and the magazine well of the firearm.
Figure 18:
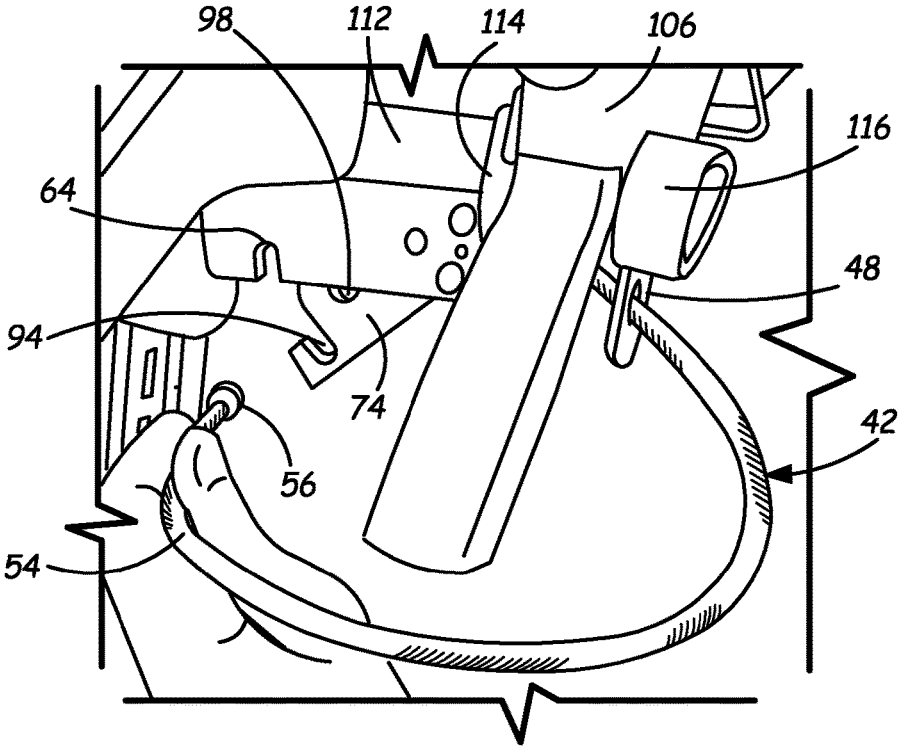
FIG. 18 is a partial perspective view showing the first end of the cable positioned for insertion into a notch of the locking plate of the firearm holder.

As shown in FIG. 16, in an exemplary embodiment, a firearm holder 30 includes aperture 62. In an exemplary embodiment, aperture 62 may be dimensioned similarly to aperture 50 of securing bracket 40, to thereby allow passage of small end 56 of cable 42 but restrict passage of large end 58 therethrough. A user can pull cord 54 of cable 42 to the right direction as illustrated only to the extent that large diameter portion 58 contacts body 112 and is prevented from passing through aperture 62 because of the relatively larger size of large end 58. FIG. 17 shows that the small end 56 of cable 42 is then passed through the aperture 50 of securing bracket 40 which has been inserted into the shell ejection slot 60 and magazine well 59 of the firearm 106. FIG. 18 shows that the cord 54 is then inserted into notch 94 of lock plate 74. As shown in FIGS. 9B and 10B, notch 94 in lock plate 74 and cooperating notch 64 in holder body 112 are sized to allow insertion of cord 54 while preventing small end 56 from pulling through.

Figure 19:
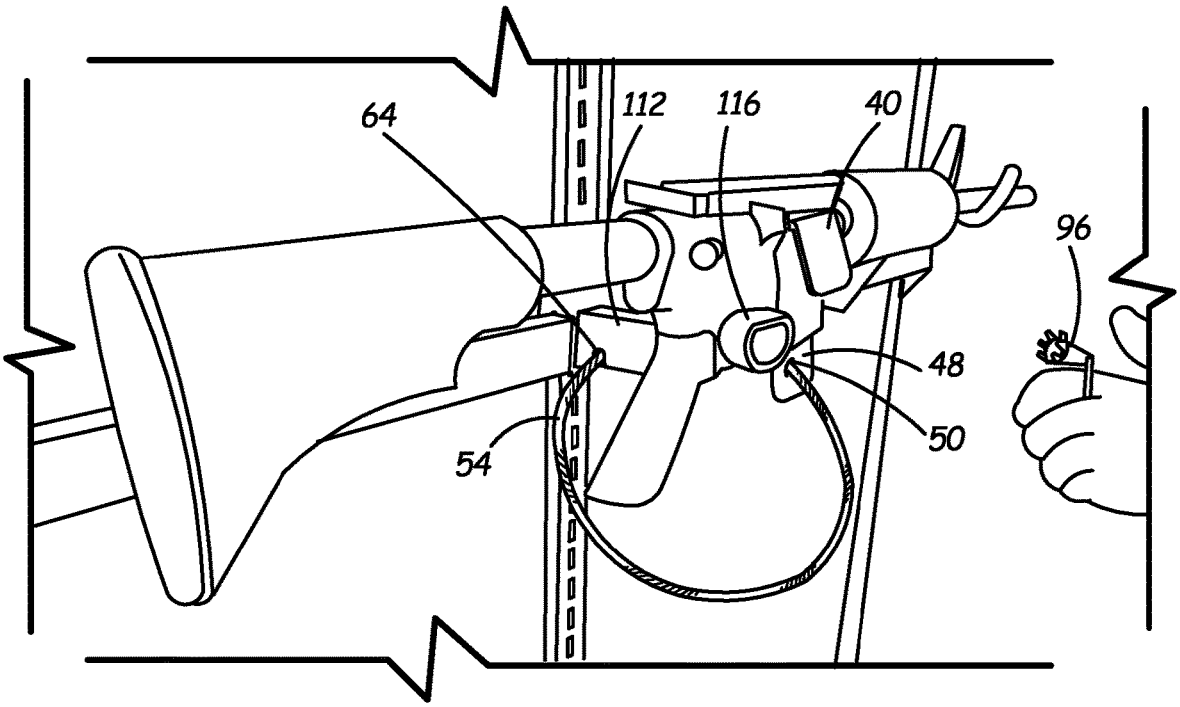
FIG. 19 is a perspective view of a firearm locked and secured in the firearm holder with the cable assembly.

As shown in FIG. 19, a user then pivots lock plate 74 upward into body 112 to enclose cord 54 within an opening formed by the cooperating notches 64 and 94 (an opening smaller than the small end 56 of cable 42). With this action, the user also engages the cooperating serrated edges 84, 86—of toothed stem 70 and lock plate 74 respectively—internally within body 112. The user inserts and actuates key 96 in lock 102 to advance the plunger pin 142 of the lock into pin aperture 98 of lock plate 74. This locking retains cord 54 of cable assembly 42 in the enclosure defined by combined notches 64, 94 and also locks together the tooth connections of lock plate 74 and tooth stem 70, preventing removal of trigger peg 110 from body 112. A suitable lock with corresponding key is commercially available from Kenstan Lock Company of Plainview, New York under the model K2 Keymatic. However, any style of plunger lock can be used. The cable assembly of FIGS. 11-19 is designed for use in securing firearms 106 to a firearm display holder 30 as illustrated but can also be used in firearm safes and other holders not designed in particular for display.

FIG. 20 is a bottom perspective view of an exemplary firearm holder 30 with support wire 36 and cable 42. The cable assembly of securing bracket 40 and cable 42, used with firearm holder 30, redundantly locks the firearm 106 to the firearm holder 30 in a visually unobtrusive manner to provide security while allowing full view of the firearm 106. The firearm holder 30 described above provides a number of advantages over conventional firearm displays. Each firearm holder 30 includes a lock mechanism to secure all firearms 106 positioned therein, preventing removal and preventing discharge of each such firearm 106. The lock 102 secures the firearm 106 to the firearm holder 30 without obscuring the firearm 106, allowing a consumer to view the firearm 106 in a retail environment or allowing an owner to display the firearm 106 in a cabinet or a gun safe. Moreover, adding the cable assembly of securing bracket 40 and cable 42 to the use of firearm holders 30 adds a second layer of security while enabling full view of the firearms.

Non-limiting embodiments of an assembly and method are described. In an exemplary embodiment, an assembly is configured for use with a firearm 106 having a trigger guard 104. In an exemplary embodiment, the assembly comprises a firearm holder 30 comprising a body 112 and a trigger peg 110. In an exemplary embodiment, the body 112 comprises an internal channel 90, a plunger lock 102, and a lock plate 74 comprising a first interlock surface 86. In an exemplary embodiment, the trigger peg 110 comprises a stem 70 and a trigger flange 114. In an exemplary embodiment, the stem 70 is configured for insertion through the trigger guard 104 and into the internal channel 90, the stem 70 comprising a second interlock surface 84 configured to mate with the first interlock surface 86. In an exemplary embodiment, the trigger flange 114 is sized to not pass through the trigger guard 104.

In an exemplary embodiment, the lock plate 74 is pivotally connected to the body 112. In an exemplary embodiment, a support wire 36 is configured for insertion through the body 112. In an exemplary embodiment, the body 112 comprises a reinforcement cylinder 122 surrounding the plunger lock 102. In an exemplary embodiment, each of the first and second interlock surfaces 86, 84 comprises a serrated edge. In an exemplary embodiment, the lock plate 74 comprises a pin aperture 98 for receipt of a plunger pin 142 of the plunger lock 102.

In an exemplary embodiment, assembly comprises a rail 32, and the body 12 comprises a first aperture 34 configured for slidable mounting on the rail 32. In an exemplary embodiment, the firearm holder 30 comprises a rail positioning flange 66. In an exemplary embodiment, the rail positioning flange 66 comprises a lip 80 configured to retain a label 82. In an exemplary embodiment, the assembly comprises a plurality of said firearm holders 30 disposed on the rail 32. In an exemplary embodiment, the rail 32 is mounted to a vertical support 100, 130. In an exemplary embodiment, the rail 32 is mounted in a cabinet 108.

In an exemplary embodiment, the firearm 106 has a shell ejection slot 60, and the assembly comprises a bracket 40 and a cable 42. In an exemplary embodiment, the bracket 40 is configured for partial insertion into the shell ejection slot 60, and the bracket 40 comprises a bracket aperture 50. In an exemplary embodiment, the cable 42 comprises a cord 54, a large end 58 and a small end 56, wherein the small end 56 is configured to pass through the bracket aperture 50. In an exemplary embodiment, the firearm holder 30 comprises a holder aperture 62 dimensioned to permit passage of the small end 56 of the cable 42 but prevent passage of the large end 58 of the cable 42. In an exemplary embodiment, the body 112 comprises a first notch 64, and the lock plate 74 comprises a second notch 94, wherein the first notch 64 and the second notch 94 are configured to overlap to form a plate aperture that surrounds the cord 54 and prevents passage of the small end 56 of the cable 42. In an exemplary embodiment, the bracket 40 comprises a front plate 44 and a tail 46, 48, wherein the tail 46, 48 is disposed at an acute angle θ relative to the front plate 44, and the bracket aperture 50 is disposed on the tail 46, 48.

In an exemplary embodiment, a method of securing a firearm 106 having a trigger guard 104 comprises positioning the trigger guard 104 at a body 112 of a firearm holder 30, inserting a stem 70 of a trigger peg 110 through the trigger guard 104 and into the body 112 of the firearm holder 30, and locking the trigger peg 110 to the body 112 of the firearm holder 30. In an exemplary embodiment, the method comprises retaining the trigger guard 104 between the body 112 of the firearm holder 30 and a trigger flange 116 of the trigger peg 110. In an exemplary embodiment, locking the trigger peg 110 to the body 112 of the firearm holder 30 comprises manipulating a key 96 of a plunger lock 102 of the body 112. In an exemplary embodiment, the method comprises pivoting a lock plate 74 of the body 112 into contact with the stem 70 before manipulating the key 96.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. An assembly configured for use with a firearm having a trigger guard, the assembly comprising:
- a rail; and
- a firearm holder comprising:
  - a body comprising:
    - an internal channel;
    - a plunger lock;
    - a lock plate comprising a first interlock surface; and
    - a first aperture configured for slidable mounting on the rail; and
  - a trigger peg comprising:
    - a stem configured for insertion through the trigger guard and into the internal channel, the stem comprising a second interlock surface configured to mate with the first interlock surface; and
    - a trigger flange sized to not pass through the trigger guard.

2. The assembly of claim 1 wherein the lock plate is pivotally connected to the body.

3. The assembly of claim 1 comprising a support wire configured for insertion through the body.

4. The assembly of claim 1 wherein the body comprises a reinforcement cylinder surrounding the plunger lock.

5. The assembly of claim 1, wherein the firearm holder comprises a rail positioning flange.

6. The assembly of claim 5 wherein the rail positioning flange comprises a lip configured to retain a label.

7. The assembly of claim 1 comprising a plurality of said firearm holders disposed on the rail.

8. The assembly of claim 1, wherein the rail is mounted to a vertical support.

9. The assembly of claim 1, wherein the rail is mounted in a cabinet.

10. The assembly of claim 1 wherein the firearm has a shell ejection slot, the assembly comprising:
- a bracket configured for partial insertion into the shell ejection slot, the bracket comprising a bracket aperture; and
- a cable comprising a cord, a large end and a small end, wherein the small end is configured to pass through the bracket aperture.

11. The assembly of claim 10, wherein the firearm holder comprises a holder aperture dimensioned to permit passage of the small end of the cable but prevent passage of the large end of the cable.

12. The assembly of claim 10 wherein:
- the body comprises a first notch; and
- the lock plate comprises a second notch;
- wherein the first notch and the second notch are configured to overlap to form a plate aperture that surrounds the cord and prevents passage of the small end of the cable.

13. The assembly of claim 10, wherein the bracket comprises a front plate and a tail, wherein:
- the tail is disposed at an acute angle relative to the front plate; and
- the bracket aperture is disposed on the tail.

14. An assembly configured for use with a firearm having a trigger guard, the assembly comprising:
- a firearm holder comprising:
  - a body comprising:
    - an internal channel;
    - a plunger lock; and
    - a lock plate comprising a first interlock surface; and
  - a trigger peg comprising:
    - a stem configured for insertion through the trigger guard and into the internal channel, the stem comprising a second interlock surface configured to mate with the first interlock surface, wherein each of the first and second interlock surfaces comprises a serrated edge; and
    - a trigger flange sized to not pass through the trigger guard.

15. The assembly of claim 14, wherein the lock plate is pivotally connected to the body.

16. The assembly of claim 14 comprising a support wire configured for insertion through the body.

17. An assembly configured for use with a firearm having a trigger guard, the assembly comprising:
- a firearm holder comprising:
  - a body comprising:
    - an internal channel;
    - a plunger lock; and
    - a lock plate comprising a first interlock surface, wherein the lock plate comprises a pin aperture for receipt of a plunger pin of the plunger lock; and
  - a trigger peg comprising:
    - a stem configured for insertion through the trigger guard and into the internal channel, the stem comprising a second interlock surface configured to mate with the first interlock surface; and
    - a trigger flan e sized to not pass through the trigger guard.

18. The assembly of claim 17, wherein the lock plate is pivotally connected to the body.

19. The assembly of claim 17 comprising a support wire configured for insertion through the body.

20. The assembly of claim 17, wherein the body comprises a reinforcement cylinder surrounding the plunger lock.

* * * * *